US010714231B2

(12) United States Patent
Won et al.

(10) Patent No.: US 10,714,231 B2
(45) Date of Patent: Jul. 14, 2020

(54) GRAPHENE WIRE, CABLE EMPLOYING THE SAME, AND METHOD OF MANUFACTURING THE SAME

(71) Applicant: HAESUNG DS CO., LTD., Gyeongsangnam-do (KR)

(72) Inventors: Dong Kwan Won, Seoul (KR); Jae Chul Ryu, Seoul (KR)

(73) Assignee: Haesung DS CO., LTD., Changwon-si (KR)

( * ) Notice: Subject to any disclaimer, the term of this patent is extended or adjusted under 35 U.S.C. 154(b) by 0 days.

(21) Appl. No.: 15/536,636

(22) PCT Filed: Feb. 27, 2017

(86) PCT No.: PCT/KR2017/002158

§ 371 (c)(1),
(2) Date: Jan. 15, 2019

(87) PCT Pub. No.: WO2018/021646

PCT Pub. Date: Feb. 1, 2018

(65) Prior Publication Data

US 2019/0385761 A1 Dec. 19, 2019

(30) Foreign Application Priority Data

Jul. 26, 2016 (KR) ..... 10-2016-0094818

(51) Int. Cl.
*H01B 1/04* (2006.01)
*H01B 7/02* (2006.01)
(Continued)

(52) U.S. Cl.
CPC ..... *H01B 1/04* (2013.01); *H01B 7/02* (2013.01); *H01B 13/0036* (2013.01); *H01B 13/06* (2013.01)

(58) Field of Classification Search
CPC ..... H01L 1/04; H01L 7/02; H01L 13/0036; H01L 13/06
(Continued)

(56) References Cited

U.S. PATENT DOCUMENTS 4,997,992 A * 3/1991 Low ..... H01B 7/303 174/113 C
8,331,602 B2 * 12/2012 Liu ..... H04R 1/1033 174/113 R
(Continued)

FOREIGN PATENT DOCUMENTS

CN 102560415 A 7/2012
CN 103824646 A 5/2014
(Continued)

OTHER PUBLICATIONS

Korean Intellectual Property Office (ISA); International Search Report PCT/KR2017/002158 dated Jun. 2, 2017; 3 pages.
(Continued)

*Primary Examiner* — Timothy J Thompson
*Assistant Examiner* — Michael F McAllister
(74) *Attorney, Agent, or Firm* — Schwabe, Williamson & Wyatt, P.C.

(57) ABSTRACT

Provided are a graphene wire, a cable to which the graphene wire is applied, and a method of manufacturing the graphene wire. The graphene wire includes a catalytic metal wire and a graphene layer coated on a surface of the catalytic metal wire, and the catalytic metal wire includes a stranded cable in which at least two core wires are twisted around each other.

10 Claims, 8 Drawing Sheets

(51) Int. Cl.
*H01B 13/06* (2006.01)
*H01B 13/00* (2006.01)

(58) Field of Classification Search
USPC ..... 174/70 R
See application file for complete search history.

(56) References Cited

U.S. PATENT DOCUMENTS

| | | | | |
|---|---|---|---|---|
| 8,445,788 | B1 * | 5/2013 | Tsotsis | H01B 1/24 174/126.1 |
| 8,808,792 | B2 * | 8/2014 | Starkovich | H01B 1/04 427/113 |
| 8,853,540 | B2 * | 10/2014 | Adriaenssens | C08K 3/04 174/126.2 |
| 9,324,472 | B2 * | 4/2016 | Lee | D06M 11/83 |
| 10,115,492 | B2 * | 10/2018 | Richmond | H01B 1/04 |
| 2002/0129969 | A1 * | 9/2002 | Groegl | H01B 7/041 174/128.1 |
| 2006/0072886 | A1 | 4/2006 | Kim | |
| 2007/0105438 | A1 * | 5/2007 | Yoshino | H01Q 1/46 439/578 |
| 2007/0284987 | A1 * | 12/2007 | Liu | B82Y 10/00 313/311 |
| 2008/0136551 | A1 * | 6/2008 | Phillips | H03H 7/38 333/32 |
| 2011/0005808 | A1 * | 1/2011 | White | H01B 1/026 174/126.2 |
| 2013/0143067 | A1 * | 6/2013 | Kim | B82Y 30/00 428/634 |
| 2014/0209346 | A1 | 7/2014 | Buck | |
| 2014/0224524 | A1 * | 8/2014 | Gazda | H01B 1/04 174/126.2 |
| 2015/0262726 | A1 * | 9/2015 | Lee | H01B 1/04 174/126.2 |
| 2017/0103823 | A1 * | 4/2017 | Chuang | H01B 1/02 |

FOREIGN PATENT DOCUMENTS

| | | | |
|---|---|---|---|
| CN | 204577124 | U | 8/2015 |
| CN | 105741975 | A | 7/2016 |
| JP | 2016-504749 | | 2/2016 |
| KR | 10-0288444 | | 5/2001 |
| KR | 10-2004-0076425 | | 9/2004 |
| KR | 10-0492957 | | 5/2005 |
| KR | 10-1503283 | | 3/2015 |
| KR | 10-1386104 | | 4/2016 |
| WO | 2015041439 | | 3/2015 |

OTHER PUBLICATIONS

China National Intellectual Property Administration, First Office Action in Chinese Patent Application No. 201780000440.9, dated Nov. 26, 2018, 8 pages, no English translation available.
KIPO; Korean Office Action for KR 10-2016-0094818, dated Jul. 1, 2017; no English translation; 6 pages.

* cited by examiner

GRAPHENE WIRE, CABLE EMPLOYING THE SAME, AND METHOD OF MANUFACTURING THE SAME

TECHNICAL FIELD

The present invention relates to a graphene wire, a cable employing the same, and a method of manufacturing the same.

BACKGROUND ART

Graphene is a material in which carbon atoms are arranged two-dimensionally. Graphene has very high electrical conductivity because electric charges act as zero effective mass particles therein, and also has high thermal conductivity and elasticity. Also, it has been reported that graphene is advantageous for transmitting radio frequency signals without the influence of noise, even in a narrow line width.

Graphene may be fabricated in the form of a wire, as well as in a flat plate form, and may be applied to wires of a circuit board that is essentially installed in electric and electronic devices, transparent displays, flexible displays, acoustic devices, etc.

DETAILED DESCRIPTION OF THE INVENTIVE CONCEPT

Technical Problem

One or more embodiments of the present invention provide a graphene wire and a method of manufacturing the graphene wire.

Technical Solution

According to an embodiment of the present invention, there is provided a graphene wire including a catalytic metal wire, and a graphene layer coated on a surface of the catalytic metal wire, wherein the catalytic metal wire includes a stranded cable in which at least two core wires are twisted around each other.

Advantageous Effects

According to embodiments of the present invention, a graphene wire and a cable include a catalytic metal wire including a stranded cable in which core wires are twisted, so as to improve tensile strength, flexibility, and electrical characteristics thereof, and a graphene layer is formed on the catalytic metal wire so as to improve electrical conductivity without damaging the graphene layer.

The effects of the present invention may be deducted from descriptions provided below with reference to accompanying drawings, as well as from the above description.

BEST MODE

Figure 1:
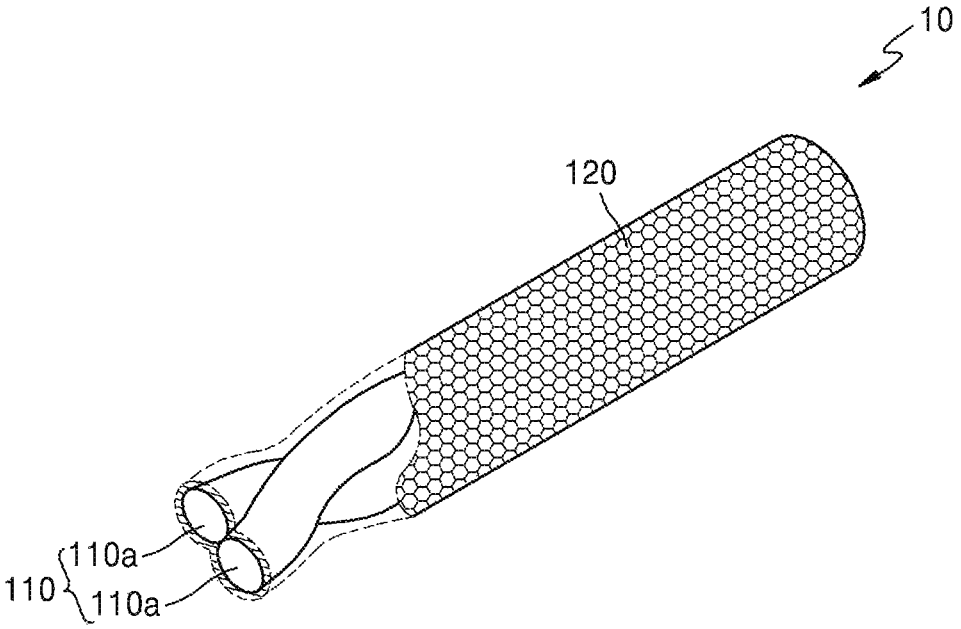
FIG. 1 is a perspective view of a graphene wire according to an embodiment of the present invention.

According to an aspect of the present invention, a graphene wire includes: a catalytic metal wire; and a graphene layer coated on a surface of the catalytic metal wire, wherein the catalytic metal wire includes a stranded cable in which at least two core wires are twisted around each other.

The catalytic metal wire may further include a metal layer coated on a surface of the stranded cable.

The metal layer may include at least one of copper (Cu), nickel (Ni), cobalt (Co), titanium (Ti), platinum (Pt), zirconium (Zr), vanadium (V), rhodium (Rh), and ruthenium (Ru).

A number of the at least two core wires may be two to ten.

The graphene wire may further include an insulating layer surrounding the graphene layer.

According to an aspect of the present invention, a cable includes: at least one graphene wire; a tension member arranged around the at least one graphene wire in a lengthwise direction thereof; and an insulating sheath surrounding circumferences of the at least one graphene wire and the tension member, wherein the at least one graphene wire includes: a stranded cable in which at least two core wires are twisted around each other; and a graphene coating layer surrounding a circumference of the stranded cable.

The stranded cable may further include a metal layer disposed on a surface of the at least two twisted core wires.

The cable may further include an insulating layer surrounding the graphene coating layer.

The tension member may include at least one of Kevlar aramid yarn, a fiber glass epoxy rod, Fiber Reinforced Polyethylene (FRP), high-strength fiber, a zinc-coated wire, and a steel wire.

The at least one graphene wire may be provided as a plurality of graphene wires, and the plurality of the graphene wires may be twisted around one another.

According to an aspect of the present invention, a method of manufacturing a cable, the method includes: forming a catalytic metal wire of a stranded cable type by twisting at least two core wires around each other; fabricating a graphene wire by synthesizing a graphene layer on a surface of the catalytic metal wire by a chemical vapor deposition method; arranging a tension member around the graphene wire in a lengthwise direction; and forming an insulating sheath surrounding the graphene wire and the tension member.

The tension member may include at least one of Kevlar aramid yarn, a fiber glass epoxy rod, Fiber Reinforced Polyethylene (FRP), high-strength fiber, a zinc-coated wire, and a steel wire.

The synthesizing of the graphene layer may be performed at a temperature higher than a melting point of the tension member.

The insulating sheath may include a fluoride resin or a weaved material.

At least one of a plasma process, a laser process, and a pre-heating process may be performed on the catalytic metal wire, before the synthesizing of the graphene layer.

Mode of the Invention

As the inventive concept allows for various changes and numerous embodiments, particular embodiments will be illustrated in the drawings and described in detail in the written description. The attached drawings for illustrating one or more embodiments are referred to in order to gain a sufficient understanding, the merits thereof, and the objectives accomplished by the implementation. However, the embodiments may have different forms and should not be construed as being limited to the descriptions set forth herein.

The example embodiments will be described below in more detail with reference to the accompanying drawings. Those components that are the same or are in correspondence are rendered the same reference numeral regardless of the figure number, and redundant explanations are omitted.

While such terms as "first," "second," etc., may be used to describe various components, such components must not be limited to the above terms. The above terms are used only to distinguish one component from another. An expression used in the singular encompasses the expression of the plural, unless it has a clearly different meaning in the context. In the present specification, it is to be understood that the terms such as "including," "having," and "comprising" are intended to indicate the existence of the features, numbers, steps, actions, components, parts, or combinations thereof disclosed in the specification, and are not intended to preclude the possibility that one or more other features, numbers, steps, actions, components, parts, or combinations thereof may exist or may be added.

It will be understood that when a layer, region, or component is referred to as being "formed on" another layer, region, or component, it can be directly or indirectly formed on the other layer, region, or component. That is, for example, intervening layers, regions, or components may be present.

Sizes of components in the drawings may be exaggerated for convenience of explanation. In other words, since sizes and thicknesses of components in the drawings are arbitrarily illustrated for convenience of explanation, the following embodiments are not limited thereto.

When a certain embodiment may be implemented differently, a specific process order may be performed differently from the described order. For example, two consecutively described processes may be performed substantially at the same time or performed in an order opposite to the described order.

Figure 2:
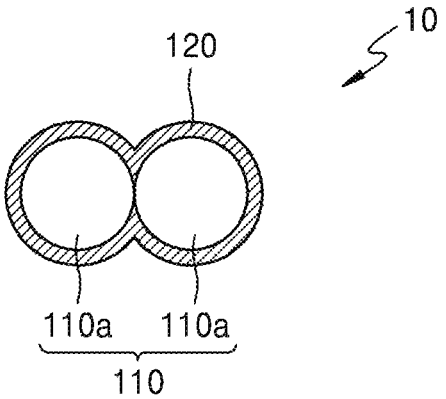
FIG. 2 is a cross-sectional view of the graphene wire of FIG. 1.
Figure 3A:
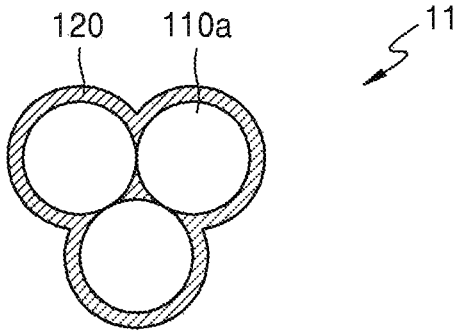
FIGS. 3A and 3B are cross-sectional views of graphene wires according other embodiments of the present invention.
Figure 3B:
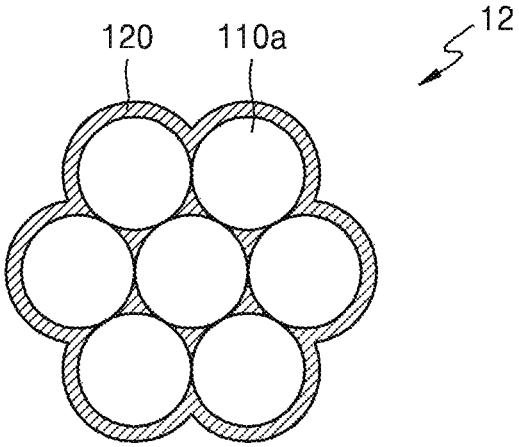

FIG. 1 is a perspective view of a graphene wire 10 according to an embodiment of the present invention, FIG. 2 is a cross-sectional view of the graphene wire 10 of FIG. 1, and FIGS. 3A and 3B are cross-sectional views of graphene wires 11 and 12 according to other embodiments of the present invention.

Referring to FIGS. 1 and 2, the graphene wire 10 includes a catalytic metal wire 110 and a graphene layer 120 coated on a surface of the catalytic metal wire 110, and the catalytic metal wire 110 includes a stranded cable in which at least two core wires 110*a* are twisted around each other.

The catalytic metal wire 110 is metal for synthesizing the graphene layer 120, and includes the stranded cable in which at least two core wires 110*a* are twisted around each other. In FIG. 1, two core wires 110*a* are twisted, but three or more core wires 110*a* may be provided as shown in FIGS. 3A and 3B. A graphene wire 11 of FIG. 3A includes a stranded cable in which three core wires 110*a* are twisted around one another, and a graphene wire 12 of FIG. 3B includes a stranded cable in which seven core wires 110*a* are twisted around one another. However, the number of the core wires 110*a* is not limited thereto. The number of core wires 110*a* may be adjusted according to the usage of the wire, and two or more core wires are included in the scope of the present invention. In some embodiments, the number of the core wires 110*a* may be two to ten. This may be applied to a flexible cable.

The plurality of core wires 110*a* may be twisted spirally in a clockwise direction or a counter-clockwise direction, so as to be provided as a stranded cable. Forming of the stranded cable by twisting the plurality of core wires 110*a* may be performed to ensure tensile strength of the wire, easiness in processing, flexibility, electrical characteristics, etc.

The core wire 110*a* may include metal for synthesizing the graphene layer 120. For example, the core wire 110*a* may include at least one of copper (Cu), nickel (Ni), cobalt (Co), titanium (Ti), zirconium (Zr), vanadium (V), rhodium (Rh), and ruthenium (Ru). The core wire 110*a* may include metal containing one of the above materials at 90% or greater, but is not limited thereto.

The graphene layer 120 is synthesized on a surface of the catalytic metal wire 110 to coat the surface of the catalytic metal wire 110. That is, the graphene layer 120 is coated on the surface of the stranded cable in which the at least two core wires 110*a* are twisted around each other.

The graphene layer 120 is in a two-dimensional (2D) plane sheet form which is formed by covalent bonds among a plurality of carbon atoms, and the carbon atoms connected through the covalent bonds form a six-membered ring as a basic repeating unit, and may further include a five-membered ring and/or a seven-membered ring. The graphene layer 120 may have various structures, and the structures may vary depending on a content of the five-membered rings and/or the seven-membered rings that may be included in the graphene layer 120. The graphene layer 120 may be a single layer including the carbon atoms connected through the covalent bonds (generally sp2 bonds), but may include multiple layers in which a plurality of single layers are stacked. The graphene layer 120 has a very high charge carrier mobility, and thus, charge velocity may be improved in the graphene wires 10, 11, and 12.

In particular, since charges may move along with a surface of a conductor under a radio frequency, the velocity of the charges in the graphene wires 10, 11, and 12 in the radio frequency may be improved by the graphene layer 120 formed on the surface of the catalytic metal wire 110.

In the embodiments of the present invention, the graphene layer 120 does not surround each of the plurality of core wires 110*a*, but surrounds the stranded cable in which the plurality of core wires 110*a* are twisted.

If the stranded cable processing operation of twisting the plurality of core wires 110*a* around one another is performed after forming the graphene layer 120 on each of the plurality of core wires 110*a*, the graphene layer 120 formed on the surface of each of the plurality of core wires 110*a* may be damaged, thereby degrading performance of the wire. In the embodiments of the present invention, after twisting the plurality of core wires 110*a* around one another, the graphene layer 120 is formed on the surface of the stranded cable, and thus, damage to the graphene layer 120 during the stranded cable processing operation may be prevented.

The graphene layer 120 may be synthesized by a chemical vapor deposition (CVD) method. For example, the catalytic metal wire 110 and a carbon-containing gas ($CH_4$, $C_2H_2$, $C_2H_4$, CO, etc.) are added into a chamber and heated so that the catalytic metal wire 110 absorbs the carbon. Then, rapid cooling is performed to crystallize the carbon, and then the graphene layer 120 may be synthesized.

FIGS. 4A to 4D are cross-sectional views of graphene wires 13, 14, and 15 and 16 according to other embodiments of the present invention. In FIGS. 4A to 4D, like reference numerals as in FIG. 1 denote the same elements, and detailed descriptions thereof are omitted.

Referring to FIGS. 4A to 4D, the graphene wires 13, 14, 15, and 16 each include the catalytic metal wire 110 and the graphene layer 120 coated on the surface of the catalytic metal wire 110, and the catalytic metal wire 110 includes a stranded cable in which two or more core wires 110*a* are twisted around one another.

The catalytic metal wire 110 includes a metal layer 113 disposed on a surface of the stranded cable. That is, the metal layer 113 is disposed between the stranded cable and the graphene layer 120. The metal layer 113 may function as a catalytic metal for synthesizing the graphene layer 120. In this case, the core wire 110*a* may include a conductive material such as copper (Cu), aluminum (Al), etc., and the metal layer 113 may include a material of the same kind as or different kind from that of the core wire 110*a*. For example, the metal layer 113 may include at least one of copper (Cu), nickel (Ni), cobalt (Co), titanium (Ti), zirconium (Zr), vanadium (V), rhodium (Rh), and ruthenium (Ru). The metal layer 113 may be formed by a plating method or a deposition method. Since the metal layer 113 functions as a catalytic metal when the graphene layer 120 is synthesized, the core wire 110*a* may include various materials other than the catalytic metal material. Otherwise, a purity of the core wire 110*a* may be lower than that of the metal layer 113. For example, the core wire 110*a* may include Cu of a low purity, and the metal layer 113 may include Cu with a purity of 99.9% or greater.

Figure 4A:
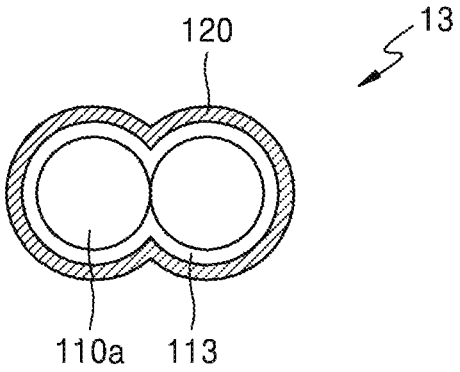
FIGS. 4A to 4D are cross-sectional views of graphene wires according to other embodiments of the present invention.
Figure 4B:
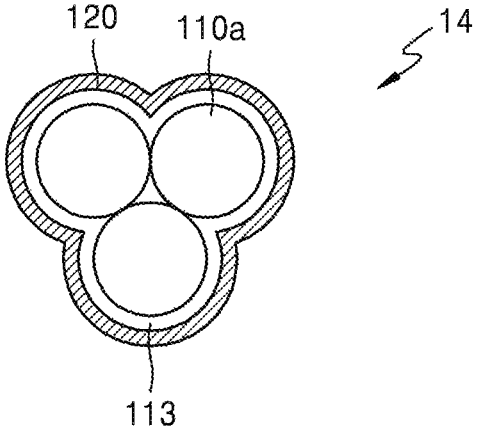
Figure 4C:
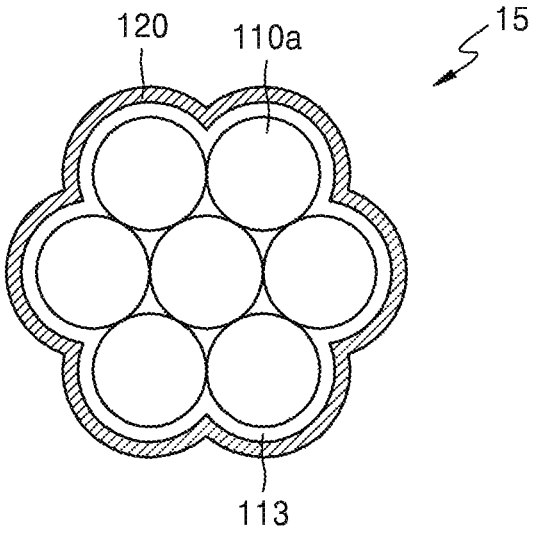
Figure 4D:
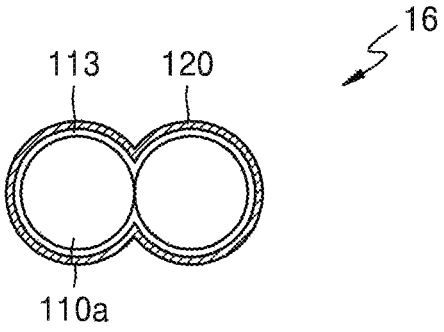

The metal layer 113 is provided for synthesizing the graphene layer 120, and may be formed after twisting the plurality of core wires 110*a*. However, one or more embodiments are not limited thereto. As shown in FIG. 4D, after forming the metal layer 113 around each of the plurality of core wires 110*a*, the plurality of core wires 110*a* may then be twisted around one another to form the stranded cable.

In the embodiments of the present invention, the graphene layer 120 does not surround each of the plurality of core wires 110*a*, but surrounds the stranded cable in which the plurality of core wires 110*a* are twisted.

If the stranded cable processing operation of twisting the plurality of core wires 110*a* around one another is performed after forming the graphene layer 120 on each of the plurality of core wires 110*a*, the graphene layer 120 formed on the surface on each of the plurality of core wires 110*a* may be damaged, thereby degrading performance of the wire. In the embodiments of the present invention, after twisting the plurality of core wires 110*a* around one another, the graphene layer 120 is formed on the surface of the stranded cable, and thus, damage to the graphene layer 120 during the stranded cable processing operation may be prevented.

Figure 5:
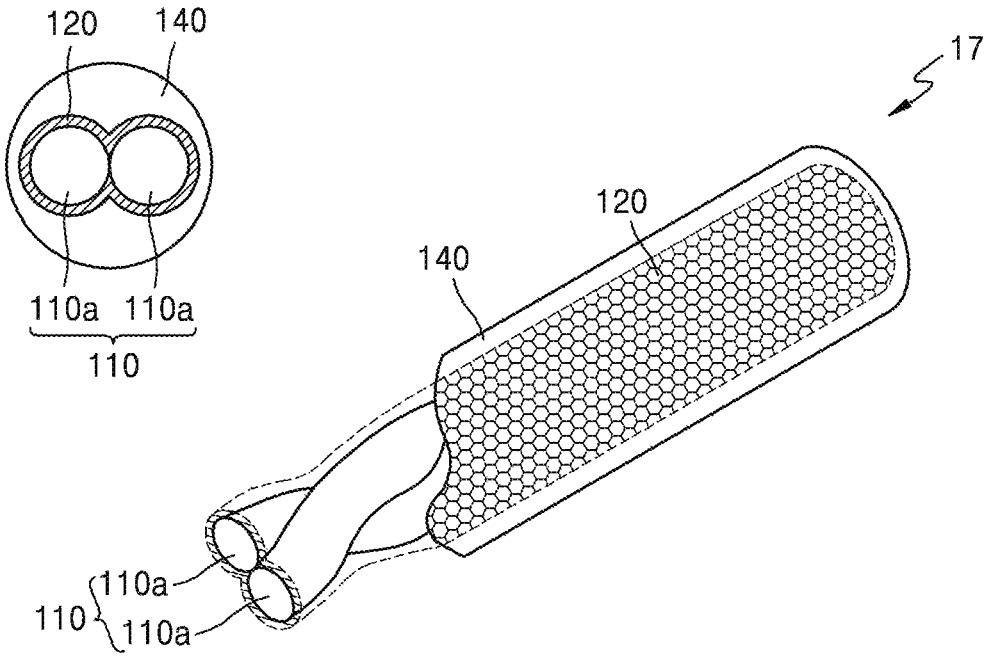
FIG. 5 is a cross-sectional view and a perspective view of a graphene wire according to another embodiment of the present invention.

FIG. 5 is a cross-sectional view and a perspective view of a graphene wire 17 according to another embodiment of the present invention. In FIG. 5, like reference numerals as in FIG. 1 denote the same elements, and detailed descriptions thereof are omitted.

Referring to FIG. 5, the graphene wire 17 includes the catalytic metal wire 110 and the graphene layer 120 coated on the surface of the catalytic metal wire 110, and the catalytic metal wire 110 includes a stranded cable in which at least two core wires 110*a* are twisted around each other. In addition, the graphene wire 17 further includes an insulating layer 140 surrounding the graphene layer 120.

The insulating layer 140 may be formed by coating an outer portion of the graphene layer 120 with an insulator such as a fluoride resin, or by surrounding the graphene layer 120 with a weaved material. The insulating layer 140 may insulate the graphene wire 17.

The fluoride resin collectively denotes resins containing fluoride in molecules, for example, polytetrafluoroethylene (PTFE), polychlorotrifluoroethylene (PCTFE), polyvinylidenefluoride (PVDF), ethylenetetrafluoroethylene (ETFE), etc., or a combination thereof. The fluoride resin may be formed as a coating product, molded article or a shaped article through a hot-melt forming process, but in a case of a fluoride resin having high melt viscosity, the fluoride resin of a powder type may be sintered to be formed as a shaped article.

The weaved material may be formed by weaving fibers, and may include polyamide fiber, polyester fiber, polyethylene fiber, polypropylene fiber, etc.

Figure 6:
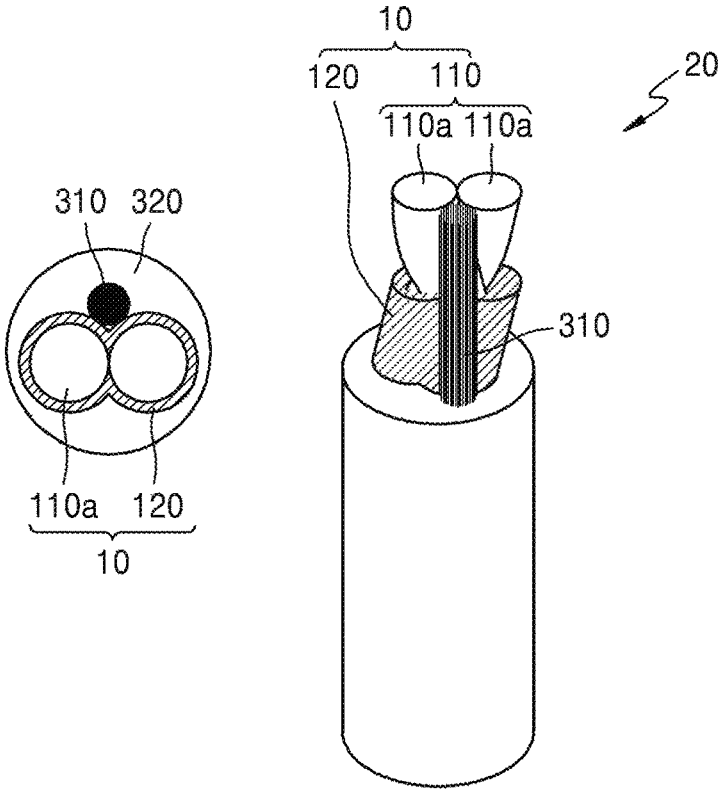
FIG. 6 is a cross-sectional view and a perspective view of a cable according to an embodiment of the present invention.
Figure 7:
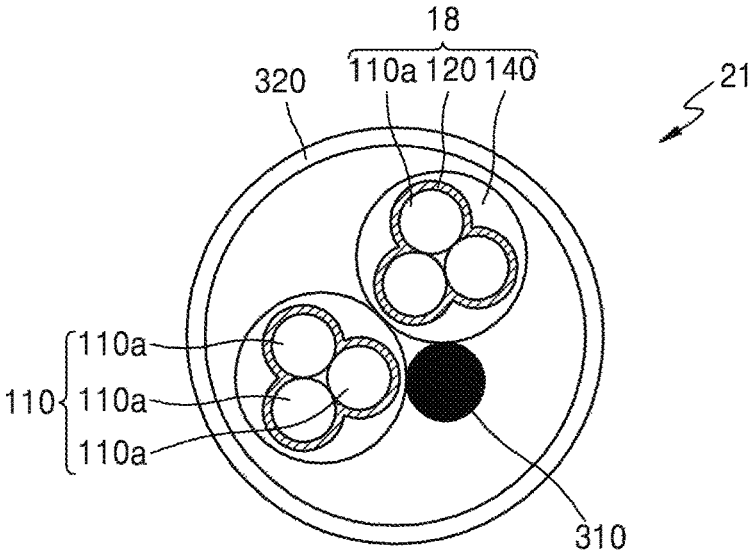
FIG. 7 is a cross-sectional view of a cable according to another embodiment of the present invention.

FIG. 6 is a cross-sectional view and perspective view of a cable 20 employing the graphene wire 10, according to an embodiment of the present invention. FIG. 7 is a cross-sectional view of a cable 21 employing a graphene wire 18, according to another embodiment of the present invention. In FIGS. 6 and 7, like reference numerals as in FIG. 1 denote the same elements, and detailed descriptions thereof are omitted.

Referring to FIG. 6, the cable 20 includes at least one graphene wire 10, a tension member 310 arranged with the graphene wire 10 in a lengthwise direction, and an insulating sheath 320 surrounding the graphene wire 10 and the tension member 310.

The graphene wire 10 includes the catalytic metal wire 110 and the graphene layer 120 coated on the surface of the catalytic metal wire 110, and the catalytic metal wire 110 includes a stranded cable in which at least two core wires 110*a* are twisted around each other.

The tension member 310 reinforces tensile strength of the cable 20, in order to protect the graphene wire 10 in the cable 20, and may include Kevlar aramid yarn, a fiber glass epoxy rod, Fiber Reinforced Polyethylene (FRP), high-strength fiber, a zinc-coated wire, a steel wire, etc. A plurality of the tension member 310 may be provided, and a diameter and the number of the tension members 310 may vary depending on a bending characteristic, a tensile strength, etc. required by the cable 20.

A melting point of the tension member 310 may be lower than a synthesis temperature of the graphene layer 120. For example, the Kevlar aramid yarn has a melting point around 300° C., which is lower than the synthesis temperature of the graphene layer 120, e.g., 600° C. to 1050° C. Therefore, the tension member 310 may not be applied before synthesizing the graphene layer 120. The tension member 310 may be applied to the cable 20 through an arranging process, after fabricating the graphene wire 10.

The insulating sheath 320 surrounds the graphene wire 10 and the tension member 310 together. The insulating sheath 320 may be formed by coating an insulator such as the fluoride resin, or by surrounding the graphene wire 10 and the tension member 310 with the weaved material.

The fluoride resin collectively denotes resins containing fluoride in molecules, for example, polytetrafluoroethylene (PTFE), polychlorotrifluoroethylene (PCTFE), polyvinylidenefluoride (PVDF), ethylenetetrafluoroethylene (ETFE), etc., or a combination thereof. The fluoride resin may be formed as a coating product, molded article or a shaped article through a hot-melt forming process, but in a case of a fluoride resin having high melt viscosity, the fluoride resin of a powder type may be sintered to be formed as a shaped article.

The weaved material may be formed by weaving fibers, and may include polyamide fiber, polyester fiber, polyethylene fiber, polypropylene fiber, etc.

In FIG. 6, the cable 20 employs the graphene wire 10 shown in FIG. 1 as an example, but the embodiments of the present invention are not limited thereto. The cable according to the embodiment of the present invention may include the graphene wires 10, 11, 12, 13, 14, 15, and 16 illustrated in FIGS. 1 to 5, and modified examples thereof.

For example, referring to FIG. 7, a cable 21 includes at least two graphene wires 18 and the tension member 310, and also includes the insulating sheath 320 surrounding the graphene wires 18 and the tension member 310.

The graphene wire 18 includes the catalytic metal wire 110 and the graphene layer 120 coated on the surface of the catalytic metal wire 110, and the catalytic metal wire 110 includes a stranded cable in which at least two core wires 110*a* are twisted around each other. Also, the graphene wire 18 may further include the insulating layer 140 surrounding the stranded cable. In FIG. 7, the catalytic metal wire 110 is shown as a stranded cable in which three core wires 110*a* are twisted around one another, but is not limited thereto.

The cable 21 includes at least two graphene wires 18, and the at least two graphene wires 18 may be twisted around each other. In FIG. 7, two graphene wires 18 are arranged, but the embodiments are not limited thereto. The number of the graphene wires 18 may vary depending on characteristics of the cable 21.

The graphene wires 10, 11, 12, 13, 14, 15, 16, 17, and 18 and the cables 20 and 21 according to the embodiments of the present invention may be applied to various fields. For example, the graphene wires 10, 11, 12, 13, 14, 15, 16, 17, and 18 and the cables 20 and 21 may be applied to communication cables, radio frequency (RF) cables, power cables, etc. In addition, the graphene wires 10, 11, 12, 13, 14, 15, 16, 17, and 18 and the cables 20 and 21 may be applied to audio cables used in earphones, headphones, or the like. Otherwise, the graphene wires 10, 11, 12, 13, 14, 15, 16, 17, and 18 and the cables 20 and 21 may be applied to audio cables connecting an audio device to a speaker.

Figure 8:
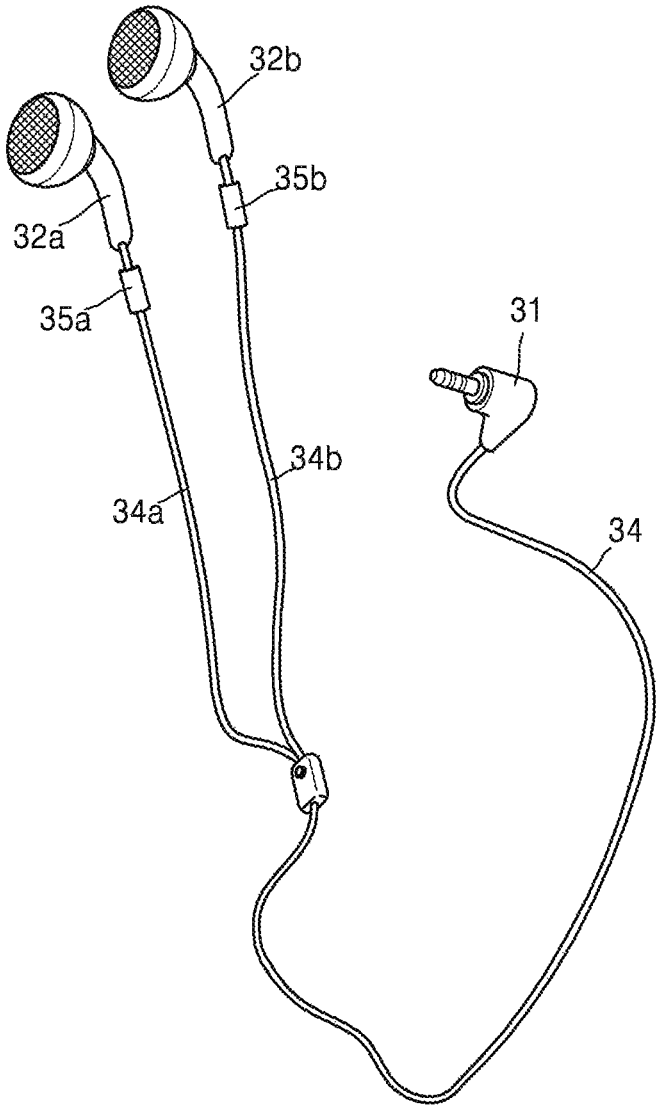
FIG. 8 is a schematic diagram of earphones to which a graphene wire or a cable according to one or more embodiments of the present invention may be applied.

For example, referring to FIG. 8, earphones include a connection jack 31, an extension cable 34, and divided cables 34*a* and 34*b* branching and extending from an end of the extension cable 34. Wearable bodies 32*a* and 32*b* that are worn in ears may be respectively coupled to one end of the divided cables 34*a* and 34*b*. An insertion recess fixture 35*a* and a protrusion fixture 35*b* may be provided on portions of the divided cables 34*a* and 34*b* which are coupled to the wearable bodies 32*a* and 32*b*. Here, the graphene wires 10, 11, 12, 13, 14, 15, 16, 17, and 18 and the cables 20 and 21 according to the embodiments of the present invention may be applied to the extension cable 34 and the divided cables 34*a* and 34*b*.

Figure 9:
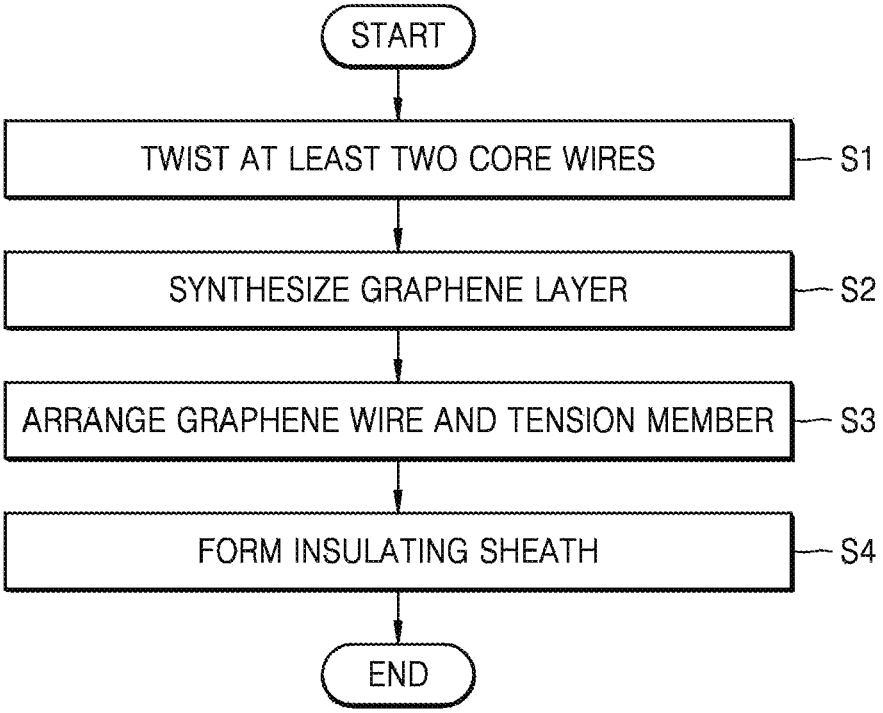
FIG. 9 is a flowchart illustrating a process of manufacturing a cable according to an embodiment of the present invention.

FIG. 9 is a flowchart illustrating a process of manufacturing the cable 20 according to an embodiment of the present invention.

Referring to FIG. 9, at least two core wires 110*a* are twisted around each other to prepare the catalytic metal wire 110 of a stranded cable type (S1). The at least two core wires 110*a* may be twisted in a clockwise direction or in a counter-clockwise direction. The catalytic metal wire 110 may be formed by plating or coating the metal layer 113 on the stranded cable. The catalytic metal wire 110 and/or the metal layer 113 may include at least one of copper (Cu), nickel (Ni), cobalt (Co), titanium (Ti), zirconium (Zr), vanadium (V), rhodium (Rh), and ruthenium (Ru).

Before forming the graphene layer 120, a process selected from the group consisting of a plasma process, a laser process, a pre-heating process, and a combination thereof may be performed on the surface of the catalytic metal wire 110. The plasma process and the laser process may be processes for removing impurities on the catalytic metal wire 110 from which the graphene will be synthesized, and for densifying a metal member. The pre-heating process may be a process for heating the catalytic metal wire 110 in advance to a temperature at which the chemical vapor deposition may be easily performed, before synthesizing and/or coating the graphene layer 120.

Next, the graphene layer 120 is synthesized on the surface of the stranded cable in which the plurality of core wires 110*a* are twisted around one another (S2). The graphene layer 120 is synthesized by the CVD method and is coated at the same time, for example, the graphene layer 120 is synthesized and coated simultaneously on the surface of the catalytic metal wire 110 by the CVD method by which a reaction gas including a carbon source is injected, but is not limited thereto.

The CVD method may include a thermal chemical vapor deposition (T-CVD) method, a rapid thermal chemical vapor deposition (RTCVD) method, a plasma-enhanced chemical vapor deposition (PECVD) method, an inductively coupled plasma-enhanced chemical vapor deposition (ICPCVD) method, a metal-organic chemical vapor deposition (MOCVD) method, a low-pressure chemical vapor deposition (LPCVD) method, an atmospheric pressure chemical vapor deposition (APCVD) method, a laser heating method, or the like, but is not limited thereto.

First, the catalytic metal wire 110 is put in a chamber, and a temperature of the catalytic metal wire 110 increases to a high temperature of 600° C. or higher, for example, about 800° C. to 1050° C. Recrystallization/crystal growth behavior of the catalytic metal wire 110 may vary depending on increasing temperature and a speed of the temperature increase. In some embodiments, the temperature increase may be performed rapidly within a few seconds to a few minutes so that sizes of crystal grains in the catalytic metal wire 110 increase and crystals may grow in a certain crystallization direction. In the above conditions, graphene having a very low resistance value may be synthesized.

Next, the carbon source is supplied to synthesize the graphene on the surface of the catalytic metal wire 110.

The carbon source is selected from the group consisting of carbon monoxide, methane, ethane, ethylene, ethanol, acetylene, propane, butane, butadiene, pentane, pentene, cyclopentadiene, hexane, cyclohexane, benzene, toluene, and combinations thereof, or a carbon source of a solid state selected from the group consisting of tar, polymer, coal, and combinations thereof, but is not limited thereto. The carbon source may exist alone, or may co-exist with an inert gas such as helium, argon, etc. In addition, the carbon source may further include hydrogen. The hydrogen may be used to maintain cleanliness of a surface of a base material and control a gas phase reaction.

When thermal treatment is performed while supplying the carbon source of a gas phase, carbon components existing in the carbon source are combined to form a plate-shaped structure of mainly hexagonal shapes on the surface of the catalytic metal wire 110 to synthesize the graphene layer 120. Next, a cooling operation is performed at a constant rate to a room temperature in order to improve stability of the synthesized graphene layer 120 and complete manufacturing of the graphene wire 10.

After manufacturing the graphene wire 10, the tension member 310 is arranged with the graphene wire 10 in the lengthwise direction thereof (S3). Then, the graphene wire 10 and the tension member 310 are surrounded by the insulating sheath 320 (S4).

The tension member 310 reinforces tensile strength of the cable 20 in order to protect the graphene wire 10 in the cable 20, and may include Kevlar aramid yarn, a fiber glass epoxy rod, Fiber Reinforced Polyethylene (FRP), high-strength fiber, a zinc-coated wire, a steel wire, etc. A plurality of the tension member 310 may be provided, and a diameter and the number of the tension members 310 may vary depending on a bending characteristic, a tensile strength, etc. required by the cable 20.

A melting point of the tension member 310 may be lower than a synthesis temperature of the graphene layer 120. For example, the Kevlar aramid yarn has a melting point of around 300° C., which is lower than the synthesis temperature of the graphene layer 120, e.g., 600° C. to 1050° C. Therefore, the tension member 310 may not be applied before synthesizing the graphene layer 120. The tension member 310 may be applied to the cable 20 through an arranging process, after fabricating the graphene wire 10.

The insulating sheath 320 surrounds the graphene wire 10 and the tension member 310 together. The insulating sheath 320 may be formed by coating an insulator such as the fluoride resin, or by surrounding the graphene wire 10 and the tension member 310 with the weaved material.

The fluoride resin collectively denotes resins containing fluoride in molecules, for example, polytetrafluoroethylene (PTFE), polychlorotrifluoroethylene (PCTFE), polyvinylidenefluoride (PVDF), ethylenetetrafluoroethylene (ETFE), etc., or a combination thereof. The fluoride resin may be formed as a coating product, molded article or a shaped article through a hot-melt forming process, but in a case of a fluoride resin having high melt viscosity, the fluoride resin of a powder type may be sintered to be formed as a shaped article.

The weaved material may be formed by weaving fibers, and may include polyamide fiber, polyester fiber, polyethylene fiber, polypropylene fiber, etc.

As described above, the graphene wires 10, 11, 12, 13, 14, 15, 16, 17, and 18 and the cables 20 and 21 according to the embodiments of the present invention include the catalytic metal wire 110 having the stranded cable in which the core wires 110*a* are twisted around one another, and thus, may have improved tensile strength, flexibility, and electrical characteristics. In addition, the graphene layer 120 is formed on the catalytic metal wire 110, and thus, electrical conductivity may be improved without damaging the graphene layer 120.

While one or more embodiments have been described with reference to the figures, it will be understood by those of ordinary skill in the art that various changes in form and details may be made therein without departing from the spirit and scope of the inventive concept as defined by the following claims.

The invention claimed is:

1. A cable comprising:

at least one graphene wire;

a tension member arranged around the at least one graphene wire in a lengthwise direction thereof; and an insulating sheath surrounding circumferences of the at least one graphene wire and the tension member, wherein the at least one graphene wire comprises:

a stranded cable in which at least two core wires are twisted around each other; and a graphene coating layer surrounding a circumference of the stranded cable.

2. The cable of claim 1, wherein the stranded cable further comprises a metal layer disposed on a surface of the at least two twisted core wires.

3. The cable of claim 1, further comprising an insulating layer surrounding the graphene coating layer.

4. The cable of claim 1, wherein the tension member comprises at least one of Kevlar aramid yarn, a fiber glass epoxy rod, Fiber Reinforced Polyethylene (FRP), high-strength fiber, a zinc-coated wire, and a steel wire.

5. The cable of claim 1, wherein the at least one graphene wire is provided as a plurality of graphene wires, and the plurality of the graphene wires are twisted around one another.

6. A method of manufacturing a cable, the method comprising:

forming a catalytic metal wire of a stranded cable type by twisting at least two core wires around each other;

fabricating a graphene wire by synthesizing a graphene layer on a surface of the catalytic metal wire by a chemical vapor deposition method;

arranging a tension member around the graphene wire in a lengthwise direction; and forming an insulating sheath surrounding the graphene wire and the tension member.

7. The method of claim 6, wherein the tension member comprises at least one of Kevlar aramid yarn, a fiber glass epoxy rod, Fiber Reinforced Polyethylene (FRP), high-strength fiber, a zinc-coated wire, and a steel wire.

8. The method of claim 6, wherein the synthesizing of the graphene layer is performed at a temperature higher than a melting point of the tension member.

9. The method of claim 6, wherein the insulating sheath includes a fluoride resin or a weaved material.

10. The method of claim 6, wherein at least one of a plasma process, a laser process, and a pre-heating process is performed on the catalytic metal wire, before the synthesizing of the graphene layer.

* * * * *